United States Patent [19]

Endoh et al.

[11] 4,385,795

[45] May 31, 1983

[54] CONNECTOR FOR FLAT CABLE

[75] Inventors: Seiji Endoh; Shotaro Tada; Toru Kuga; Yasuo Takeda, all of Kanuma; Kazuo Mitsui; Yoji Yoshimura, both of Kawasaki, all of Japan

[73] Assignee: Sumitomo Electric Industries, Ltd., Osaka, Japan

[21] Appl. No.: 214,907

[22] Filed: Dec. 10, 1980

[30] Foreign Application Priority Data

Dec. 28, 1979 [JP] Japan ..... 54-172112

[51] Int. Cl.[3] ..... H01R 4/48

[52] U.S. Cl. ..... 339/176 MF; 339/17 F; 339/17 LC

[58] Field of Search ..... 339/17 LC, 17 C, 17 F, 339/176 MF, 176 MP

[56] References Cited

U.S. PATENT DOCUMENTS

| | | | |
|---|---|---|---|
| 3,384,864 | 5/1968 | Schwartz | 339/17 LC |
| 3,399,377 | 8/1968 | Warzecka | 339/176 MP |
| 3,493,916 | 2/1970 | Hansen | 339/17 LC |
| 3,587,029 | 6/1971 | Knowles | 339/14 |
| 3,671,813 | 6/1972 | Wilcox | 317/118 |
| 3,696,319 | 10/1972 | Olsson | 339/17 F |
| 4,087,148 | 5/1978 | Bauerle | 339/75 MP |

*Primary Examiner*—John McQuade
*Assistant Examiner*—Gary F. Paumen
*Attorney, Agent, or Firm*—Sughrue, Mion, Zinn, Macpeak, and Seas

[57] ABSTRACT

A connector adapted to be detachably connected to a flat electric cable having terminal members including contact portions and legs connected to the contact portions which are bent in such a manner that the end portions of the legs are staggered alternately in a zigzag manner forming two lines of legs. The end portions of the legs extend either in the axial or the direction perpendicular to the axial direction of the connector. The legs may be made of equal length before bending and or bent preferably such that the ends of all of the legs flow substantially in the same plane.

3 Claims, 10 Drawing Figures

CONNECTOR FOR FLAT CABLE

BACKGROUND OF THE INVENTION

The present invention relates to a connector for flat electric cable which is used for wiring electronic equipment such as a computer.

Flat electric cable, which is frequently employed for wiring electronic equipment, is manufactured by juxtaposing plural conductors and molding the assembled conductors with insulation material into a tape-shaped cable.

To connect flat electric cable to a printed circuit board in electronic equipment, a connector and a terminal block shown in FIGS. 1A-1C can be employed. FIG. 1A is a perspective view of the connector. The connector includes a housing 2 having a cable insertion hole 3 and a plurality of resilient contacts 4 arranged in the cable insertion hole 3. As shown in FIG. 1C which is a sectional view taken along line 1C—1C in FIG. 1A, each of the contacts 4 has a portion extending through the housing 2 to serve as a leg 5 of the connector terminal. In FIGS. 1A and 1C, reference numeral 10 designates partition walls which are formed on the inner surface of one side of the housing.

The terminal member 6 of the flat electric cable which is inserted into the cable insertion hole 3 of the connector is formed as follows. End portions of the conductors 8 of the flat cord 7 are exposed by removing portions of the insulation material from the cable after which a plastic plate 9 is bonded to one side of the flat cable 7. The plastic plate 9 is longer than the exposed parts of the conductors 8. Flat electric cables with such terminal members 6 are commercially available.

In the connector 1, the legs 5 of the terminals are arranged at equal intervals at a pitch A in a single line. The pitch A of the legs is equal to the pitch P of the conductors 4 in the connector, that is, the pitch B of the conductors in the flat electric cable.

The legs 5 of the connector terminals are soldered to a printed circuit board or the like. In view of the accuracy of a pattern formed on a printed circuit board and the accuracy and reliability of the legs which are soldered to the printed circuit board, the pattern pitch corresponding to the pitch A of the legs 5 of the connector terminals is limited. Accordingly, it is not practical to reduce the pitch A to less than a certain limiting value. In the case of manufacturing the connectors on a large scale, the limiting pitch of the legs along the same line is 1/10 inch. That is, it is impossible to decrease the pitch of the legs 5 to less than that value so that the density of the connector terminals is correspondingly limited.

Accordingly, the primary object of the present invention is to eliminate the above-described difficulties accompanying a conventional connector.

SUMMARY OF THE INVENTION

In accordance with this and other objects of the invention, there is provided a connector in which the end portions of the legs of connector terminals are arranged in a zigzag manner so that the pitch of the end portions of the legs which are to be soldered to a printed circuit board is within a conventional pitch range while the pitch of the contacts coupled to the conductors of a mating flat electric cable, with the contacts and the conductors having the same pitch, is reduced to about a half of that of the contacts of a connector in which the end portions of the legs of the connector terminals are arranged in a straight line thereby significantly increasing the packing density.

A specific advantageous feature of the invention is the provision of a connector which is to be coupled to a flat electric cable in which the legs of the connectors terminals are bent in such a manner that the end portion of the legs are arranged in a zigzag manner forming two lines.

BRIEF DESCRIPTION OF THE DRAWINGS

FIGS. 1A-1C are diagrams showing examples of a prior art connector and the terminal part of a flat cable of which FIG. 1A is a perspective view of the connector, FIG. 1B is a perspective view of the terminal part of the flat cable, and FIG. 1C is a sectional view taken along line 1C—1C in FIG. 1A;

FIGS. 2A-2C are diagrams showing a preferred embodiment of a vertical type connector according to the invention of which FIG. 2A is a perspective view of the connector and FIGS. 2B and 2C are sectional views taken along lines 2B—2B and 2C—2C, respectively, in FIG. 2A;

FIGS. 3A-3C are diagrams showing preferred embodiments of a horizontal type connector according to the invention of which FIG. 3A is a perspective view of the connector and FIGS. 3B and 3C are sectional views taken along lines 3B—3B and 3C—3C respectively, in FIG. 3A.

DESCRIPTION OF THE PREFERRED EMBODIMENTS

Preferred embodiments of the invention will be described with reference to FIGS. 2 through 4.

Figure 1A:
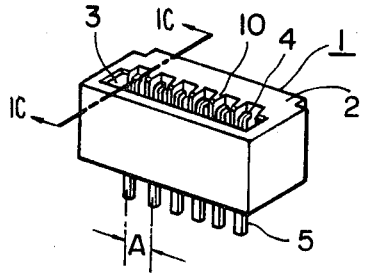
FIG. 1A (PRIOR ART)
Figure 2A:
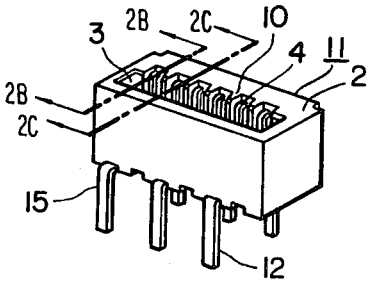
Figure 1B:
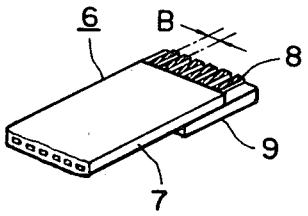
FIG. 1B (PRIOR ART)
Figure 2B:
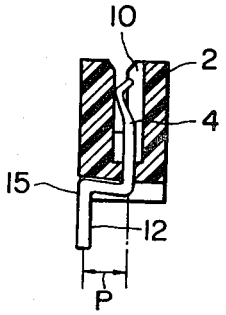
Figure 1C:
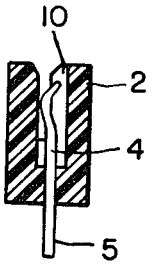
FIG. 1C (PRIOR ART)
Figure 2C:
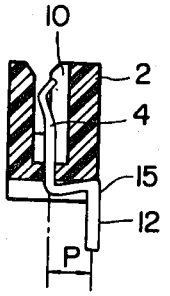

FIGS. 2A-2C show a preferred embodiment of a vertical type connector constructed according to the invention. More specifically, FIG. 2A is a perspective view of the vertical type connector, FIG. 2B is a sectional view taken along line 2B—2B in FIG. 2A, and FIG. 2C is also a sectional view taken along line 2C—2C in FIG. 2A. In FIGS. 2A-2C, those components which have been described with reference to FIGS. 1A-1C are similarly numbered.

The structure of the wire insertion hole 3 of the connector 11 is the same as that of the connector in FIGS. 1A and 1C. As shown in FIGS. 2A-2C, the leg 15 of each of the connector terminals is bent through 90° in the widthwise direction of the connector at the outlet of the housing 2 and is then again bent through 90° but in the opposite direction so that the end portion 12 of the leg 15 extends along the axis of the leg 15. In this case, adjacent legs 15 are bent in opposite directions. Accordingly, the end portions 12 of the legs 15 are arranged in two lines which are spaced with a pitch P, P being the pitch of the contacts 4, from the axes of the legs 15 in the opposite directions.

Figure 4:
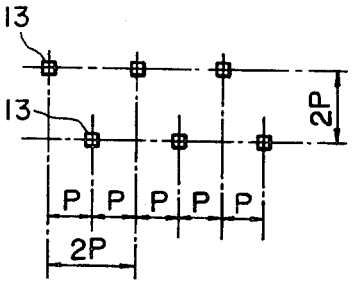
FIG. 4 is a plan view showing the arrangement of holes in a printed circuit board into which the end portions of the legs of connector terminals shown in FIGS. 2A-2C or 3A-3C are inserted.

FIG. 4 is a top view showing the arrangement of holes in a printed circuit board into which the end portions of the legs of the connector described above are inserted. As shown in FIG. 4, six holes 13 are alternately arranged in two lines. The holes have a pitch of 2P not only in the horizontal direction but also in the vertical direction.

Since the end portions of the legs are staggered or arranged in a zigzag manner as described above, the pitch of the end portions of the legs is twice the pitch P of the contacts so that the pitch P of the contacts, which is the same as the pitch of the conductors of the flat cable, can accordingly be decreased. That is, the packing density can be increased.

In this connection, if the bending margins (corresponding to P in this case) of the legs 15 of the terminals are made equal, then the legs 15 can be made equal in length before bending. That is, it is unnecessary to change the lengths of the legs separately depending on their positions. This facilitates the manufacture of the connector of the invention.

Figure 3A:
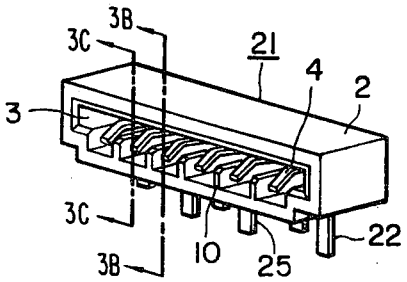
Figure 3B:
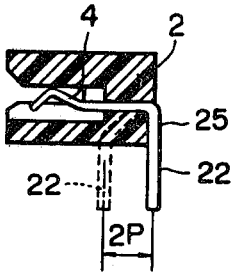
Figure 3C:
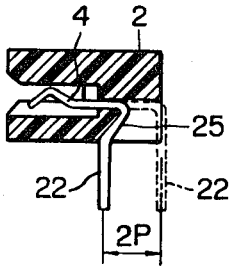

FIGS. 3A–3C show a preferred embodiment of a horizontal type connector according to the invention. More specifically, FIG. 3A is a perspective view of the connector and FIGS. 3B and 3C are sectional views taken, respectively, along lines 3B—3B and 3C—3C in FIG. 3A. In FIGS. 3A–3C, those components which have been previously described with reference to FIGS. 1A–1C and 2A–2C are similarly numbered.

The structure of the cable insertion hole 3 of the connector 21 is similar to that of the connector 11 shown in FIGS. 2A–2C. However, it should be noted that while the connector in FIG. 2 is of the vertical type, the connector in FIG. 3 is of the horizontal type. Alternate legs 25 of the connector terminals are bent as shown in FIG. 3B. That is, a first group of alternate ones of the legs 25 are bent through 90° in the direction of width of the connector so that the end portions 22 of the legs 25 extend perpendicularly to the axis of the connector. The remaining legs 25 of a second group are bent as shown in FIG. 3C. That is, the legs 25 of the second group are bent through 90° in the widthwise direction of the connector at a point closer to the contact than the legs of the first group so that the end portions 22 of the legs 25 extend perpendicularly to the axis of the connector. In this case, the end portions 22 of the legs 25 are arranged in two lines which are spaced a distance 2P from each other, P being the pitch of the contacts 4.

In this case also, the arrangement of holes formed in a printed circuit board into which the end portions of the legs are inserted is the same as that shown in FIG. 4. The pitch of the end portions of the legs is twice the pitch P of the contacts 4 and accordingly the pitch of conductors in the flat electric cable with which the connector is used can be reduced as much so that the packing density can be significantly increased.

In this case, the legs 25 of the first group which are bent through 90° at points closer to the contacts 4 than those of the second group, are bent with a bending margin which is longer than that of the second group as shown in FIGS. 3B and 3C. Accordingly, the connector can be manufactured with terminals having legs of equal length before bending. That is, it is necessary to provide terminals whose legs are the same in length.

In accordance with the invention, it is not always necessary that both the pitch between the two lines in which the holes are arranged for receiving the legs of the connector terminals and the pitch of the end portions of the legs be precisely equal to twice the pitch of the contacts. That is, the former may be somewhat different from twice the latter. In any event, the packing density is significantly increased.

As is clear from the above description, according to the invention, the legs of the terminals of a connector which is adapted to be connected to a flat cable are bent in such a manner that the end portions of the legs are staggered alternately or in a zigzag manner forming two lines. Accordingly, the pitch of the end portions of the legs is about twice the pitch P of the contacts and therefore the pitch P of the contacts, which is the same as the pitch of the conductors in the flat cable, can be decreased as much as a result of which the packing density is increased. This is a significant merit of the invention.

Furthermore, according to the invention, in bending the legs of the connector terminals, the lengths of the legs can be made equal by adjusting the bending margins of the legs before the legs are bent. Therefore, it is unnecessary to make the lengths of the legs different from one another according to their positions. This facilitates the manufacture of the connector.

What is claimed is:

1. A horizontal connector adapted to be detachably connected to a flat electric cable comprising: a housing having a cable insertion hole formed therein; and terminal members having ends disposed in said cable insertion hole, said terminal members having legs opposite said ends, said legs extending from said cable insertion hole along a single line, a first group of said legs being bent substantially 90° at a point outside said cable insertion hole so as to extend in a direction perpendicular to the axial direction of said connector, a second group of said legs alternating with said legs of said first group being bent at a position closer to a center of said housing than said legs of said first group at an angle greater than 90°, said second group of said legs being bent a second time at a position near an outer surface of said housing so that end portions of said second group of said legs extend in a direction substantially parallel to end portions of said first group of said legs, said end portions of said legs being staggered alternatively in a zigzag manner in two parallel lines, said legs being of equal length before being bent and said legs being bent such that said end portions of all of said legs are substantially in a common plane.

2. The connector as claimed in claim 1 wherein the pitch between adjacent legs in either of said lines of legs is equal to the pitch between said lines.

3. The connector as claimed in claim 1 wherein said housing has a separate set of surfaces disposed outside said cable insertion hole for each group of legs, each of said legs in each of said groups being bent against a corresponding surface of said corresponding separate set of surfaces.

* * * * *